US006897637B2

(12) United States Patent
Chen et al.

(10) Patent No.: US 6,897,637 B2
(45) Date of Patent: May 24, 2005

(54) LOW DROP-OUT VOLTAGE REGULATOR WITH POWER SUPPLY REJECTION BOOST CIRCUIT

(75) Inventors: Jun Chen, Allen, TX (US); Siew K. Hoon, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 124 days.

(21) Appl. No.: 10/314,931

(22) Filed: Dec. 9, 2002

(65) Prior Publication Data

US 2003/0111987 A1 Jun. 19, 2003

Related U.S. Application Data

(60) Provisional application No. 60/340,550, filed on Dec. 13, 2001.

(51) Int. Cl.[7] ..... G05F 1/618

(52) U.S. Cl. ..... 323/274; 323/303

(58) Field of Search ..... 323/303, 273, 323/274, 275, 280, 281

(56) References Cited

U.S. PATENT DOCUMENTS 3,344,340 A * 9/1967 Webb ..... 323/273
3,538,423 A * 11/1970 Goleniewski ..... 323/275
4,933,625 A * 6/1990 Hayakawa ..... 323/275
5,191,278 A * 3/1993 Carpenter ..... 323/275
5,550,461 A * 8/1996 Pouzoullic ..... 323/269
5,909,109 A * 6/1999 Phillips ..... 323/277
5,929,617 A * 7/1999 Brokaw ..... 323/280
5,955,915 A * 9/1999 Edwards ..... 327/541
6,707,340 B1 * 3/2004 Gough ..... 330/260

* cited by examiner

*Primary Examiner*—Gary L. Laxton
(74) *Attorney, Agent, or Firm*—Alan K. Stewart; W. James Brady, III; Frederick J. Telecky, Jr.

(57) ABSTRACT

A low drop-out voltage regulator uses a voltage subtractor circuit 36 to form a power supply rejection boost circuit. The voltage subtractor 36 is inserted between the pass element 20 and the amplifier 26 of the low drop-out regulator. The voltage regulator circuit includes a pass element 20 coupled between an input node and an output node; a voltage feedback circuit 28 and 30 coupled to the output node Vo; an amplifier 26 having an input coupled to the voltage feedback circuit; and a voltage subtractor 36 having a control node coupled to an output of the amplifier 26, an output coupled to a control node of the pass element 20, and an input coupled to the input node. The boost circuit improves supply noise rejection performance significantly without adding much complexity to the regulator system. The boost circuit is simple and consumes negligible silicon area and power.

8 Claims, 1 Drawing Sheet

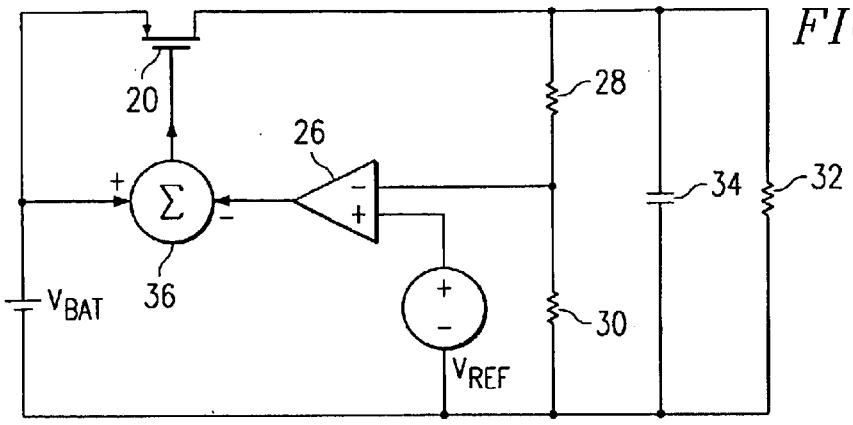
FIG. 1
FIG. 2
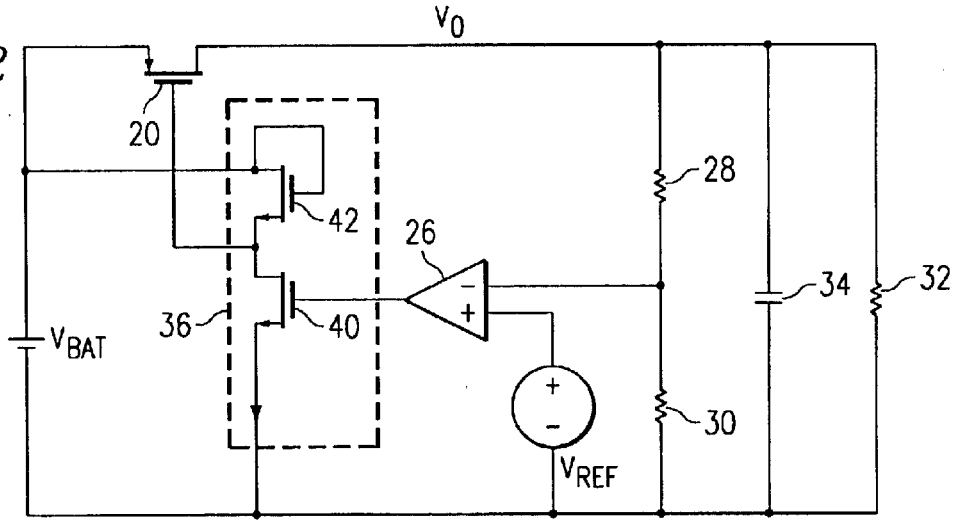
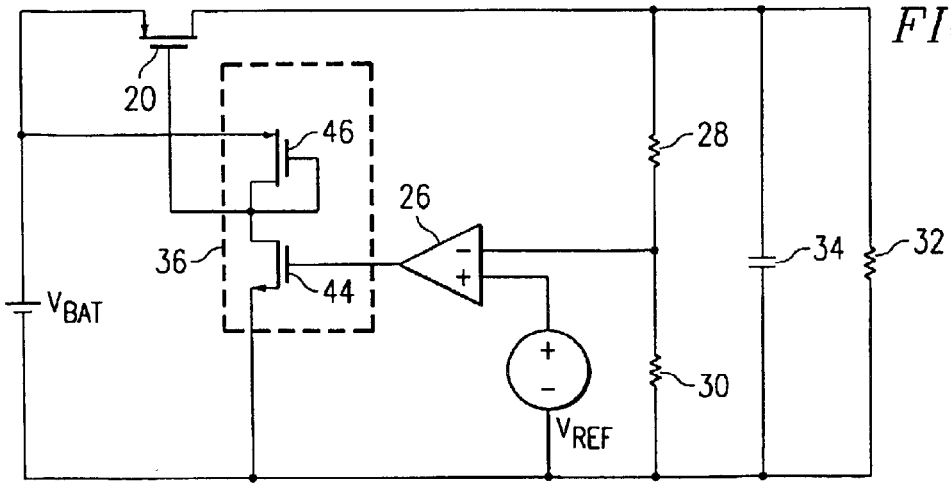
FIG. 3

LOW DROP-OUT VOLTAGE REGULATOR WITH POWER SUPPLY REJECTION BOOST CIRCUIT

This application claims priority under 35 USC § 119 (e) (1) of provisional application No. 60/340,550 filed Dec. 13, 2001.

FIELD OF THE INVENTION

This invention generally relates to electronic systems and in particular it relates to low drop-out voltage regulators.

BACKGROUND OF THE INVENTION

Low drop-out voltage regulators (LDO) are widely used in portable electronics equipment such as cellular phones, pagers, and digital cameras to provide a constant-voltage power supply for analog/digital circuits. The power supply rejection ratio (PSRR) is one of the most important requirements for the LDO design, which measures the LDO's ability to suppress power supply noise. In conventional LDO design, the PSRR is mainly determined by the open-loop gain of the error amplifier in the negative feedback circuit. The conventional LDO suffers from an inherent PSRR performance limitation. This limitation is due to the difficulty in the design of the error amplifier with high open-loop gain and high bandwidth. An approach to improve the PSRR is to increase the area of the power PMOS in the LDO, but it is restricted by the area requirement.

SUMMARY OF THE INVENTION

A low drop-out voltage regulator uses a voltage subtractor circuit to form a power supply rejection boost circuit. The voltage subtractor is inserted between the pass element and the amplifier of the low drop-out regulator. The voltage regulator circuit includes a pass element coupled between an input node and an output node; a voltage feedback circuit coupled to the output node; an amplifier having an input coupled to the voltage feedback circuit; and a voltage subtractor having a control node coupled to an output of the amplifier, an output coupled to a control node of the pass element, and an input coupled to the input node.

BRIEF DESCRIPTION OF THE DRAWINGS

In the drawings:

FIG. 1 is a schematic circuit diagram of a preferred embodiment low drop-out voltage regulator with power supply rejection boost circuitry.

FIGS. 2 and 3 are schematic circuit diagrams of two implementations of a voltage subtractor shown in FIG. 1.

DETAILED DESCRIPTION OF PREFERRED EMBODIMENTS

A preferred embodiment low drop-out voltage regulator with power supply rejection boost circuitry is shown in FIG. 1. The circuit of FIG. 1 includes transistor 20; power supply Vbat; amplifier 26; resistors 28, 30, and 32; voltage reference Vref; capacitor 34; voltage subtractor 36; and output Vo. Transistor 20 is a power PMOS pass transistor (pass element). Resistors 28 and 30 form a resistor divider feedback circuit. Resistor 32 and capacitor 34 represent an output load.

The power supply rejection boost circuitry is a voltage subtractor 36. The voltage subtractor 36 increases the PSRR by a significant amount without changing the error amplifier 26, the power PMOS 20, or any other circuit in the LDO. The voltage subtractor 36 is inserted between the control terminal of the LDO (gate terminal of the power PMOS 20) and the output terminal of the error amplifier 26. The variation of the control voltage (Vgs of PMOS 20) caused by the disturbance of the input voltage Vbat of the LDO can be cancelled out by the voltage subtractor 36. Therefore, the output voltage at node Vo becomes much less sensitive to the power supply noise. In addition, the voltage subtractor 36 has very small output resistance, and high current driving capability which improves the transient and frequency response of the LDO.

FIGS. 2 and 3 show two implementations of the voltage subtractor 36. In FIG. 2, voltage subtractor 36 is formed by NMOS transistors 40 and 42. In FIG. 3, voltage subtractor 36 is formed by NMOS transistor 44 and PMOS transistor 46. In the circuits of FIGS. 2 and 3, the voltage subtractor circuit 36 is simple, consisting of only two small transistors, and requires negligible quiescent current.

The power supply rejection boost circuitry improves supply noise rejection performance significantly without adding much complexity to the regulator system. The boost circuit is simple and consumes negligible silicon area and power.

While this invention has been described with reference to an illustrative embodiment, this description is not intended to be construed in a limiting sense. Various modifications of the illustrative embodiment, as well as other embodiments of the invention, will be apparent to persons skilled in the art upon reference to the description. It is therefore intended that the appended claims encompass any such modifications or embodiments.

What is claimed is:

1. A circuit comprising:

a pass element coupled between an input node and an output node;

a voltage feedback circuit coupled to the output node;

an amplifier having an input coupled to the voltage feedback circuit;

a first transistor coupled to a control node of the pass element, and a control node of the first transistor coupled to an output of the amplifier; and a second transistor coupled between the control node of the pass element and the input node wherein a control node of the second transistor is coupled to the input node.

2. The circuit of claim 1 wherein the pass element is a transistor.

3. The circuit of claim 1 wherein the pass element is a MOS transistor.

4. The circuit of claim 1 wherein the pass element is a PMOS transistor.

5. The circuit of claim 1 wherein the first and second transistors are NMOS transistors.

6. The circuit of claim 1 wherein the feedback circuit is a resistor divider circuit.

7. The circuit of claim 1 wherein the feedback circuit comprises:

a first resistor coupled between the output node and the input of the amplifier; and a second resistor coupled between the input of the amplifier and a common node.

8. The circuit of claim 1 further comprising a voltage reference coupled to a second input of the amplifier.

* * * * *